US007209046B2

(12) United States Patent
Röpke

(10) Patent No.: US 7,209,046 B2
(45) Date of Patent: Apr. 24, 2007

(54) METHOD FOR THE DETECTION AND SIGNALING OF DEW FILMS IN SMOKE DETECTORS

(75) Inventor: Gerhard Röpke, Travemünde (DE)

(73) Assignee: Job Lizenz GmbH & Co. KG, Ahrensburg (DE)

( * ) Notice: Subject to any disclaimer, the term of this patent is extended or adjusted under 35 U.S.C. 154(b) by 175 days.

(21) Appl. No.: 11/127,504

(22) Filed: May 12, 2005

(65) Prior Publication Data

US 2005/0253730 A1 Nov. 17, 2005

(30) Foreign Application Priority Data

May 13, 2004 (DE) ..... 10 2004 023 524

(51) Int. Cl.
*G08B 17/10* (2006.01)

(52) U.S. Cl. ..... 340/628; 340/630; 340/501; 340/522; 250/573; 356/438

(58) Field of Classification Search ..... 340/628, 340/630, 521, 522, 501, 511; 250/573; 356/438
See application file for complete search history.

(56) References Cited

U.S. PATENT DOCUMENTS 4,166,960 A 9/1979 Meili
4,180,742 A 12/1979 Malinowski
4,232,307 A 11/1980 Marsocci
4,242,673 A 12/1980 Cooper
5,008,559 A 4/1991 Beyersdorf
5,482,371 A 1/1996 Nishizawa et al.
5,568,130 A * 10/1996 Dahl ..... 340/630

FOREIGN PATENT DOCUMENTS

DE 27 54 139 A1 7/1978
DE 43 07 585 C1 3/1994
EP 0 076 338 A1 4/1983
EP 0 360 126 B1 2/1994
EP 0 615 218 B1 9/1994
JP 02018696 A 1/1990

* cited by examiner

*Primary Examiner*—Jeffery Hofsass
*Assistant Examiner*—Hongmin Fan
(74) *Attorney, Agent, or Firm*—Marjama & Bilinski LLP

(57) ABSTRACT

A method for the detection and signaling of smoke by means of an optical assembly in a detector casing, the optical assembly including at least one optical transmitter element and at least one optical receiver element, and which emits a reception signal which is representative of the incident amount of light. An electronic evaluation device compares the reception signal to a setpoint and an alarm signal is generated when the reception signal reaches the predetermined threshold value. The temperature is measured on or in the detector casing and the temporal characteristic of the temperature is correlated with the temporal characteristic of the reception signal of the optical receiver element and a dew film signal is generated when the rise in the reception signal is correlated to a rise in temperature.

4 Claims, 1 Drawing Sheet

METHOD FOR THE DETECTION AND SIGNALING OF DEW FILMS IN SMOKE DETECTORS

FIELD OF THE INVENTION

The invention relates to a method for the detection and signaling of dew films in an optical smoke detector.

BACKGROUND OF THE INVENTION

Fire detection sensors are frequently designed as optical smoke sensors or smoke detectors. They function according to the Tyndall or diffused-light principle in most cases. Enumerated below are a number of documents on the state of the art that disclose various smoke detector assemblies: U.S. Pat. No. 4,242,673, U.S. Pat. No. 4,232,307, DE 27 54 139 A1, EP 0 076 338 A1, U.S. Pat. No. 4,180,742, and EP 0 360 126.

Error sources for the detection of smoke by means of such smoke detectors are parasitic light or diffused light that does not originate from smoke particles. Hence, light entering the detector casing from the outside can cause the generation of an alarm signal. The aspiration for such detector casings is that no external light at all or only very little light should get into the measuring length, if ever possible. However, since the detector casing has to present sufficient openings through which smoke particles might penetrate the entry of parasitic light cannot be avoided completely.

Another origin of parasitic light is a contamination of the detector chamber. Dirt which deposits on the walls of the detector casing leads to an intensification of diffused light. The higher the degree of contamination is, the more intense is the diffused-light fraction that is caused thereby. Therefore, the generation of an alarm signal must be expected from a certain degree of contamination onwards unless counteractions are taken. However, the generation of erroneously produced alarm signals should be avoided in any case because it could become expensive for the operator of a system of smoke detectors because a fire-brigade needs to be called. Therefore, EP 0 360 126 which was mentioned already proposes an efficient assembly by means of which a contamination of the measuring chamber walls is detected. This is accomplished by detecting and evaluating the reflection of an irradiated area of a measuring chamber wall. The degree of reflection increases with an increase in contamination. The measured value representative of a contamination can be used to adequately correct the threshold value so as to keep the sensitivity of the smoke detector approximately constant. By measuring the contamination of the measuring chamber, however, it is also possible to generate an alarm signal which preferably is provided to a detection control room in order that the contaminated detector be exchanged or cleaned.

A third error source consists in that a dew film forms within the smoke detector. In this case, small water droplets develop on dew film nuclei on the surface of the measuring chamber walls and on the optical elements, e.g. lenses or plastic bodies of the light transmitters or light receivers. In contrast, the electronic circuit for evaluating the measurement signals in the smoke detector can be protected against moisture very well and can be provided with a protective varnish or be embedded in a sealing compound.

The enhanced reflective property of the measuring chamber walls, when due to the moisture coat, generates an increased reception signal on the light-sensitive receiver. If no additional measures are taken the alarm threshold for smoke will be reached within a very short time and, hence, a false alarm will occur.

It is known to provide constructional steps to form a smoke chamber casing or a measuring chamber as well as a specific arrangement of the optical elements by which a dew film formation is supposed to be prevented. However, it is recognizable that a dew film formation ultimately cannot be prevented. This is why proposals were made to provide such detectors with a heater element. However, the heater element requires a corresponding amount of energy. Furthermore, it changes the behaviour of smoke penetration into the measuring chamber of the smoke detector.

Another possibility is to provide a humidity sensor which measures humidity in the area which directly surrounds the smoke detector. There is a hazard of the humidity sensor getting contaminated in case of an service life. As a result, there will also be errors in the measurement of air humidity. Furthermore, durable and long-life humidity sensors are relatively expensive. Finally, it is necessary to tune fire detectors including humidity sensors to each other while they are produced, which increases their manufacturing expenses.

DE 4 307 585 C1 has made known a method and apparatus for compensating humidity in a diffused-light detector. A moisture coating on the reception optics is detected by means of a further light transmitter and the light receiver that exists already by getting the smoke density periodically measured by the first light transmitter and humidity by the second light transmitter in a time-shifted manner. The two values measured are processed with the moisture coating reflecting the light of the second light transmitter while attenuating the receiver's output signal in dependence on the thickness of the moisture coating. An assembly of this type is also relatively expensive and does not absolutely safely lead to the target of avoiding the detrimental effect of a dew film.

SUMMARY OF THE INVENTION

Accordingly, it is a general object of the invention to provide a method for the detection and signaling of smoke in which the effects exerted by dew film formation are eliminated or compensated.

In the inventive method, the temperature is measured on or in the detector casing and the temporal characteristic of the temperature is correlated with the characteristic of the output signal of the optical receiver. A so-called dew film signal is generated when the rise in the reception signal is correlate to a rise in temperature.

It is preferred to suppress an alarm signal when a dew film signal is generated. In addition or alternatively, the threshold value of the alarm signal can be adequately corrected in response to the reception signal when a dew film signal has been generated. This manner allows to measure the smoke even during the deposition of a dew film.

According to an aspect, the dew film signal may be sent to a central control room to enable the detector to be mounted at a different location, if required, if it tends to be dewed at its location.

The invention is based on the finding that the formation of a dew film in a measuring chamber of a smoke detector basically is provoked by the fact that the dew point is reached on the surface of the measuring chamber room.

If the intensity of the reflective light received increases on the receiver this shows the existence of smoke, leaving all perturbing actions aside. The formation of a dew film also results in an increase in diffused light and, therefore, can pretend that smoke is entering. Now, if an increase in temperature is measured concurrently with a rise in the reception signal, which represents an increase in diffused light, this is an indication of a dew film existing in the measuring chamber.

BRIEF DESCRIPTION OF THE DRAWINGS

The invention will be described in more detail below with reference to the drawings.

DETAILED DESCRIPTION

Figure 1:
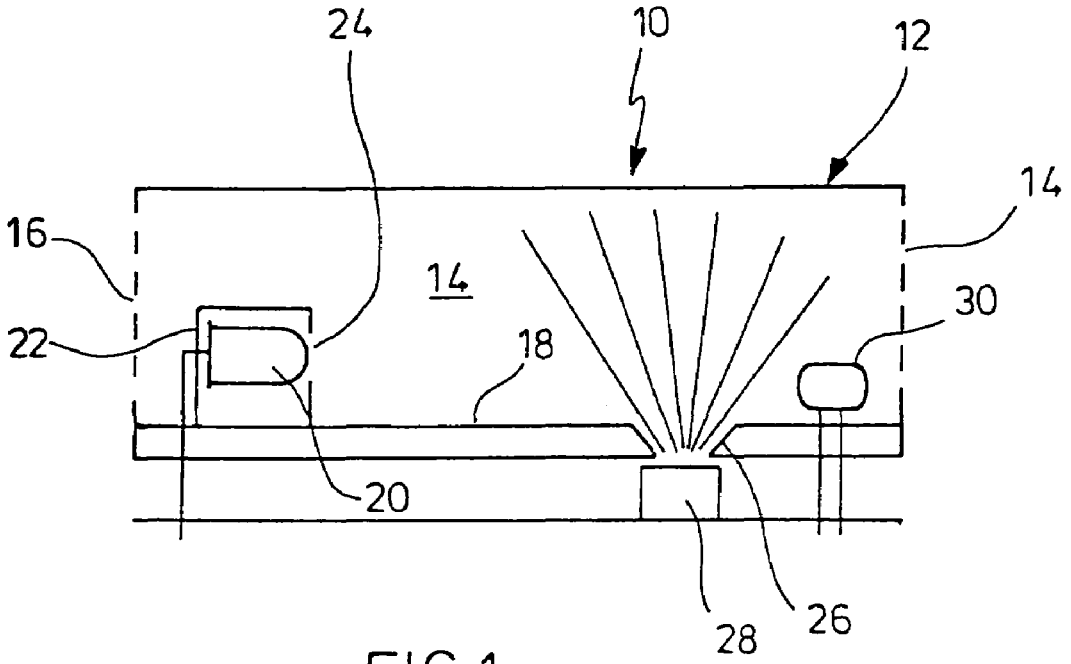
FIG. 1 is a schematic view of an optical smoke detector according to the invention.

In FIG. 1, a smoke detector 10 is shown schematically. The detector 10 has a casing 12 which has formed therein a measuring chamber 14 which has openings at opposed ends at 14 and 16 to allow for the entry of smoke. Arranged on a circuit patchboard 18 is a light-sensitive receiver 20. The receiver 20 is surrounded by a box 22 which has an opening at 24 to allow for the entry of light. The circuit patchboard 18 has provided therein an opening 26 under which an optical transmitter 28 is arranged, e.g., an LED. The transmitter 28 sends light upwardly to the measuring chamber 14 crosswise to the field of view of the receiver 20, with the light reflected from the chamber walls being received as a diffused light by the receiver 20.

Further, a temperature sensor 30 is disposed in the measuring chamber 14 to measure the temperature in the casing 12.

Further, a temperature sensor 30 is disposed in the measuring chamber 14 to measure the temperature in the casing.

The evaluation of the signals from the light-sensitive receiver 20 is made by means of a suitable electronic circuitry; it is not shown in detail. It is known as such. It is common to predetermine a threshold value where an alarm signal is generated when the reception signal of the receiver 20 reaches or exceeds this threshold value. Also, compensation steps may be provided which compensate for diffused-light effects that are provoked by other causes. This was discussed in some detail previously.

Figure 2:
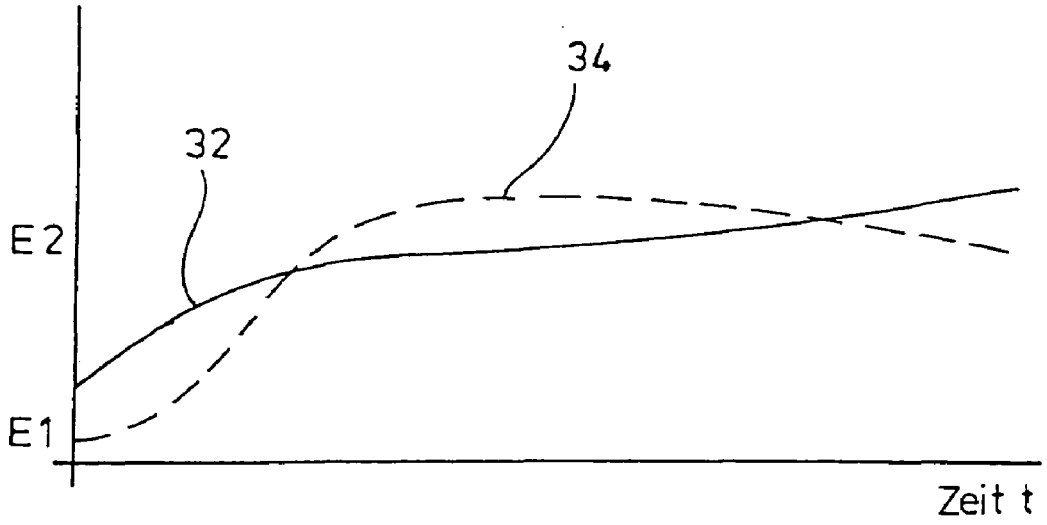
FIG. 2 depicts the temporal characteristic of a detector signal and the temperature in the measuring chamber of the detector of FIG. 1.

In the graph of FIG. 2, the continuous curve 32 represents a temperature curve of the temperature sensor 30. The curve 32 indicates that the temperature has risen in the measuring chamber 14 within a certain period. The phantom curve 34 represents the characteristic of the reception signal of the light-sensitive receiver 20, which makes it evident that the amount of parasitic light that is incident on the receiver has increased in the course of a period.

When an optical detector is set, it is necessary first to verify the optical property of the measuring chamber wall via a simple combination of the transmitter 28 and receiver 20. The light beams of the transmitter 28 are reflected from the wall of the measuring chamber and are registered by the receiver 20. For example, if the condition of the measuring chamber 14 is new and has not a dew film, an intensity E1 will be measured on the receiver 20. The dew film nuclei cause the light to be scattered on the measuring chamber walls and an increased intensity to be measured, e.g. in E2. If the temperature rises in the measuring chamber 14 at the same time as is illustrated by the curve 32, this is an indication that a dew film has deposited on the measuring chamber wall and the increased intensity of the reception signal at least is not due to smoke alone.

The reception signal of the receiver 20 is an aid in adequately correcting the threshold value for a detection of smoke. This not only prevents false alarms, but additionally allows for a detection of smoke. Moreover, it allows to send a signal from the smoke detector 10 to a central control room to make it recognizable there which smoke detector suffers from a dew film. If required, the smoke detector may be shifted to a more appropriate location.

We claim:

1. A method for the detection and signaling of dew films in optical smoke detector by means of an optical assembly in a detector casing, the optical assembly including at least one optical transmitter element and at least one optical receiver element, said optical receiver element emitting a reception signal that is representative of the incident amount of light, the method including the steps of:

comparing the reception signal to a setpoint using an electronic evaluation device;

generating an alarm signal when the reception signal reaches a predetermined threshold value wherein said electronic evaluation device compares the reception signal to a setpoint and an alarm signal is generated when the reception signal reaches a predetermined threshold value, the temperature being measured on at least one of on and in the detector casing;

correlating the temporal characteristic of the temperature with the temporal characteristic of the reception signal of the optical receiver element; and generating a dew film signal when the rise in the reception signal is correlated to a rise in temperature.

2. The method according to claim 1, including the step of suppressing the formation of an alarm signal when a dew film signal has been generated.

3. The method according to claim 1, including the step of suppressing the threshold value adequately in response to the reception signal when a dew film signal has been generated.

4. The method according to claim 1, including the step of sending the dew film signal or occurrence of a dew film signal to a central control room.

* * * * *